US009027524B2

(12) United States Patent
Musasa et al.

(10) Patent No.: US 9,027,524 B2
(45) Date of Patent: May 12, 2015

(54) SPARK PLUG FOR INTERNAL COMBUSTION ENGINE AND METHOD OF MANUFACTURING THE SAME

(75) Inventors: Mamoru Musasa, Aichi (JP); Akira Suzuki, Aichi (JP); Osamu Yoshimoto, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 942 days.

(21) Appl. No.: 12/735,343

(22) PCT Filed: Dec. 24, 2008

(86) PCT No.: PCT/JP2008/073409

§ 371 (c)(1),
(2), (4) Date: Jul. 7, 2010

(87) PCT Pub. No.: WO2009/087894

PCT Pub. Date: Jul. 16, 2009

(65) Prior Publication Data

US 2010/0275869 A1 Nov. 4, 2010

(30) Foreign Application Priority Data

Jan. 10, 2008 (JP) ..... 2008-003265

(51) Int. Cl.

| | |
|---|---|
| ***H01T 13/39*** | (2006.01) |
| ***C22C 1/04*** | (2006.01) |
| ***C22C 5/04*** | (2006.01) |
| ***C22C 9/00*** | (2006.01) |
| ***C22C 19/03*** | (2006.01) |
| ***C22C 32/00*** | (2006.01) |

(Continued)

(52) U.S. Cl.

CPC ..... *H01T 13/39* (2013.01); *Y10T 29/49002* (2015.01); *C22C 1/0466* (2013.01); *C22C 5/04* (2013.01); *C22C 9/00* (2013.01); *C22C 19/03* (2013.01); *C22C 32/0021* (2013.01); *H01T 13/32* (2013.01); *H01T 21/02* (2013.01)

(58) Field of Classification Search

CPC ..... H01T 13/20; H01T 13/26; H01T 13/39
USPC ..... 123/169 EL, 169 R; 313/141–144
See application file for complete search history.

(56) References Cited

U.S. PATENT DOCUMENTS

| | | | | |
|---|---|---|---|---|
| 6,046,532 | A * | 4/2000 | Matsutani et al. | 313/141 |
| 6,215,234 | B1 * | 4/2001 | Abe et al. | 313/141 |
| 7,131,191 | B2 * | 11/2006 | Matsutani et al. | 29/825 |

(Continued)

FOREIGN PATENT DOCUMENTS

| | | | |
|---|---|---|---|
| CN | 1035323 | 9/1989 | C22C 5/04 |
| CN | 1797880 | 7/2006 | H01T 13/39 |

(Continued)

OTHER PUBLICATIONS

Chinese Office Action (from corresponding Chinese Patent App. No. 2008-80121979), issued on Aug. 16, 2012; 13 pages (including English tanslation of same).

(Continued)

*Primary Examiner* — Hieu T Vo
*Assistant Examiner* — Sherman Manley
(74) *Attorney, Agent, or Firm* — Kusner & Jaffe

(57) ABSTRACT

A spark plug capable of preventing a separation of a noble metal tip and capable of extending a service-life of the spark plug.

7 Claims, 7 Drawing Sheets

(51) Int. Cl.
*H01T 13/32* (2006.01)
*H01T 21/02* (2006.01)

(56) References Cited

U.S. PATENT DOCUMENTS

| | | | | |
|---|---|---|---|---|
| 7,132,782 | B2 * | 11/2006 | Kato et al. | 313/141 |
| 7,336,024 | B2 | 2/2008 | Yoshimoto et al. | 313/141 |
| 7,550,906 | B2 * | 6/2009 | Yoshimoto et al. | 313/141 |
| 7,663,296 | B2 | 2/2010 | Kunitomo et al. | 313/141 |
| RE41,944 | E * | 11/2010 | Matsutani et al. | 29/825 |
| 2003/0178925 | A1 | 9/2003 | Kumagai et al. | 313/141 |
| 2005/0194878 | A1 | 9/2005 | Watanabe | 313/141 |
| 2006/0152129 | A1 | 7/2006 | Yoshimoto et al. | 313/141 |
| 2007/0228916 | A1 | 10/2007 | Kunitomo et al. | 313/143 |
| 2007/0236125 | A1 * | 10/2007 | Lykowski et al. | 313/141 |

FOREIGN PATENT DOCUMENTS

| | | | |
|---|---|---|---|
| JP | 58034151 | 2/1983 | H01T 13/39 |
| JP | 60-185384 | 9/1985 | H01T 13/20 |
| JP | 61-135083 | 6/1986 | H01T 13/39 |
| JP | 61-30014 | 7/1986 | H01T 13/20 |
| JP | 9070820 | 3/1997 | B23D 57/00 |
| JP | 11-154583 | 6/1999 | H01T 13/39 |
| JP | 2002-260819 | 9/2002 | H01T 13/39 |
| JP | 2005-203121 | 7/2005 | H01T 13/20 |
| JP | 2005-251519 | 9/2005 | H01T 13/39 |
| JP | 2005-268115 | 9/2005 | H01T 13/39 |
| JP | 2006-210325 | 8/2006 | H01T 13/39 |
| JP | 2007-294412 | 11/2007 | H01T 13/20 |

OTHER PUBLICATIONS

Form PCT/ISA/210—Int'l Search Report (from corresponding Int'l Patent App. No. PCT/JP2008/073409); 4 pages.

Japanese Office Action (from corresponding Japanese Patent App. No. 2009-517784), issued on Jul. 3, 2012; 7 pages (including English translation of same).

* cited by examiner

SPARK PLUG FOR INTERNAL COMBUSTION ENGINE AND METHOD OF MANUFACTURING THE SAME

FIELD OF THE INVENTION

The present invention relates to a spark plug used for internal-combustion engines, and a method for manufacturing the same.

BACKGROUND OF THE INVENTION

A spark plug for internal-combustion engines is mounted on an internal-combustion engine, and is used to ignite an air-fuel mixture in a combustion chamber. Generally, a spark plug is provided with an insulator having therein an axial bore, a center electrode inserted in the axial bore, a metal shell formed in an outer circumference of the insulator and a ground electrode provided on a front end face of the metal shell to form a spark discharge gap with the center electrode.

Further, it has been disclosed that a noble metal tip made of a noble metal alloy, such as platinum, is joined to a front end portion of the ground electrode made of a heat and corrosion resistant metal, such as a nickel alloy, so as to improve durability of a spark plug See, for example, Japanese Patent Application Laid-Open (kokai) No. 2003-323962.

However, crystal grains of platinum tend to get rough and large (grain growth) at a high temperature. When the grains grow, grain boundary intensity deteriorates. Thus, vibration accompanying an engine operation or heat cycles in the engine is likely to cause cracking of a noble metal tip, resulting in a separation of the noble metal tip.

In recent years, although the noble metal tip is formed so as to project from the ground electrode in order to improve ignitability and flame propagation property thereof, this configuration tends to cause deterioration in heat conduction of the noble metal tip, resulting in the noble metal tip having a high temperature. Therefore, the grain growth is more likely to advance, and the separation of the noble metal tip is more likely to occur.

The present invention has been accomplished in view of the above-mentioned problems. An advantage of the present invention is a spark plug for internal-combustion engines that is capable of preventing a separation of a noble metal tip and extending a service-life of the spark plug.

SUMMARY OF THE INVENTION

Each aspect of the present invention, which is suitable for solving the above-mentioned problems, will be described in the following paragraphs. In addition, an effect specific to the aspect will be described if necessary.

According to a first aspect of the present invention there is provided a spark plug for internal-combustion engines comprising: a cylindrical insulator having an axial bore that extends in an axial direction; a center electrode inserted in the axial bore; a cylindrical metal shell surrounding an outer circumference of the insulator; a ground electrode provided on a front end face of the metal shell so that a front end portion of the ground electrode faces a front end face of the center electrode; and a noble metal tip joined to the ground electrode so as to form a spark discharge gap between a front end portion of the noble metal tip and a front end portion of the center electrode, and the noble metal tip made of a platinum alloy that contains platinum as a principal component, wherein a projection length from a main body of the ground electrode to a front end face of the noble metal tip falls within the range from 0.4 mm or more to 1.6 mm or less, and wherein the platinum alloy has a mean particle size of 70 micrometers or less after being heated at 1100 degrees C. under an air atmosphere for 50 hours.

In used through this description, the term "principal component" means a component that has the highest mass ratio in the material. In addition, the term "projection length" refers to a distance from the main body of the ground electrode to the front end face of the noble metal tip in the axial direction of the noble metal tip, and the term "main body of the ground electrode" means a flat portion of the ground electrode which excludes a convex portion or the like formed on the surface of the ground electrode. Therefore, when a convex portion or the like is formed (or a convex-shaped metal member is welded) on the flat portion of the ground electrode and the noble metal tip is provided thereon, the projection length is to be the distance from the flat portion of the main body of the ground electrode to the front end face of the noble metal tip. Further, the term "mean particle size" means a mean value of the grain size obtained from a cross-section of the noble metal tip. Furthermore, a noble metal tip may be provided on a front end portion of the center electrode. In this case, the spark discharge gap is formed between the noble metal tip provided on the center electrode and the noble metal tip provided on the ground electrode.

According to the first aspect of the present invention, since the projection length from the main body of the ground electrode to the front end face of the noble metal tip falls within the range from 0.4 mm or more to 1.6 mm or less, improvement in ignitability and flame propagation property is achievable.

On the other hand, since the noble metal tip projects from the main body of the ground electrode, heat conduction of the noble metal tip deteriorates, and the noble metal tip is likely to have a high temperature. Therefore, the grain growth of the noble metal tip tends to advance and cause deterioration in boundary intensity. As a result, a separation of the noble metal tip is likely to occur.

According to the first aspect, since the platinum alloy has a mean particle size of 70 micrometers or less after being heated at 1100 degrees C. under the air atmosphere for 50 hours, deterioration in grain boundary intensity under high temperature environment can be prevented. Further, the separation of the noble metal tip can be prevented. As a result, a service-life of the spark plug may be extended.

When the projection length is less than 0.4 mm, improvement in ignitability or the like is unlikely to be achievable, and the noble metal tip is also unlikely to have a high temperature to the extent that the separation of the noble metal occurs due to the grain growth. That is, the present invention exhibits the effects when the noble metal tip projects from the main body of the ground electrode. However, when the projection length exceeds 1.6 mm, an erosion of the noble metal tip is more likely to occur and the service-life thereof is unlikely to be extended even though the noble metal tip where the grain growth is prevented is employed. Further, when the noble metal tip has a relatively small diameter with respect to the projection length, the effect of the present invention is further enhanced. The reason for this is that the thus-configured noble metal tip is likely to get high temperature compared to a noble metal tip not having such configuration.

In accordance with a second aspect of the present invention there is provided a spark plug for internal-combustion engines as described above, wherein a stress remaining in the front end portion of the noble metal tip is smaller than that remaining in a side portion of the noble metal tip.

According to the second aspect, in a stress remaining in the noble metal tip (hereinafter referred to as a residual stress), the stress remaining in the front end portion of the noble metal tip is smaller than that remaining in the side portion of the noble metal tip. In a metal member, a recrystallization temperature of a metal structure decreases as the residual stress becomes large. Paradoxically, the recrystallization temperature rises as the residual stress becomes small, resulting in the grains being unlikely to grow. That is, when comparing the front end portion of the noble metal tip to the side portion of the noble metal tip, the grain growth is unlikely to occur at the front end portion. Therefore, deterioration in the grain boundary intensity caused by the grain growth is unlikely to occur in the front end portion of the noble metal tip. Further, wearing of a part of the noble metal tip, such as a cracking along the grain boundary, can be prevented. As a result, it is possible to prevent an enlargement of the spark discharge gap in an early stage and to extend a service-life of the spark plug.

The residual stress can be removed soon after using the spark plug (also called as an initial stage in use). However, it is possible to prevent a sharp increase in the spark discharge gap at the initial stage in use in such a manner that the residual stress of the front end portion is made smaller than that of the side portion. Thus, this aspect is effective.

The residual stress of a surface of the noble metal tip can be measured, for example, by a Vickers hardness tester. That is, when the Vickers hardness of the front end face of the noble metal tip is smaller than that of the side face of the noble metal tip, it can be said that the residual stress of the front end face of the noble metal tip is smaller than the residual stress of the side face of the noble metal tip.

In accordance with a third aspect of the present invention there is provided a spark plug for internal-combustion engines as described above, wherein the platinum alloy contains at least one kind of components selected from rhodium (Rh), iridium (Ir), nickel (Ni) and ruthenium (Ru).

When the platinum alloy according to the first aspect is formed, various components can be adopted. Particularly, in view of preventing the grain growth, it is effective that the platinum alloy contains a component having a relatively high melting point, such as tungsten (W) and tantalum (Ta). However, tungsten (W) and tantalum (Ta) or the like are very easily oxidized. Thus, although the separation of the noble metal tip can be prevented, spark erosion resistance thereof may be deteriorated.

According to the third aspect, the platinum alloy contains at least one kind of components selected from Rh, Ir, Ni and Ru. When the platinum alloy according to the first aspect contains such a metal component, the deterioration in spark erosion resistance can be prevented. As a result, the service-life of the spark plug can be further extended.

In view of the above-mentioned aspects, it is preferable that the platinum alloy contains neither W nor Ta. However, if the platinum alloy contains W or Ta, the content of such component is preferably less than 2 mass %.

In accordance with a fourth aspect of the present invention there is provided a spark plug for internal-combustion engines as described above, wherein the platinum alloy contains at least either a metal oxide or a rare earth oxide, and wherein a total content of the metal oxide and/or the rare earth oxide falls within the range from 0.05 mass % or more to 2 mass % or less.

According to the fourth aspect, the platinum alloy contains at least either the metal oxide or the rare earth oxide. Thus, the grain growth can be further prevented and the above-mentioned effects of the aspects are further enhanced.

In addition, when the total content of the metal oxide and/or the rare earth oxide is less than 0.05 mass %, there is a possibility that the above-mentioned effects may not fully exhibited. On the other hand, when the total content is greater than 2 mass %, workability of the platinum alloy deteriorates, leading to a difficulty in forming the noble metal tip.

In accordance with a fifth aspect of the present invention there is provided a spark plug for internal-combustion engines as described above, wherein the metal shell has a thread portion on an outer circumference thereof so as to engage with a mounting hole of an engine head of an internal-combustion engine, and wherein the spark plug satisfies the following expression of:

$$H>=0.5M,$$

where "M" is an outer diameter of the thread portion, and where "H" is a distance from a front end face of the metal shell in the axial direction to a molten portion formed by which the noble metal tip and the main body of the ground electrode or a convex portion projecting from the main body of the ground electrode are melted together.

The term "molten portion" means a portion where a metal material from the noble metal tip and a metal material from the main body of the ground electrode are melted together when the noble metal tip is directly joined to the main body of the ground electrode. Further, when the noble metal tip is indirectly joined to the main body of the ground electrode through the convex portion, the molten portion means a portion where a metal material from the noble metal tip and that from the convex portion are melted together. Further, the distance H can be measured from a point of molten portion corresponding to a contact face (boundary) between the ground electrode (convex portion) and the noble metal tip in the case where the contact face is identified.

According to the fifth aspect, the spark plug satisfies the expression of H>=0.5M, where M is the outer diameter of the thread portion of the metal shell, and H is the distance from the front end face of the metal shell to the molten portion in the axial direction. Thus, since the molten portion can be brought closer to the center of the combustion chamber, the spark discharge gap can also reach the center of the combustion chamber. As a result, since a spark discharge is conducted in a position closer to the center of the combustion chamber, improvement in flame propagation property is achievable. On the other hand, the temperature of the noble metal tip at the time of combustion is determined by the outer diameter of the thread portion of the metal shell and the cross-sectional area of the ground electrode. In the spark plug having a small nominal diameter of the thread, i.e., a spark plug having the small diameter, since the cross-sectional area of the ground electrode has to be small, the noble metal tip is likely to get high temperature. That is, when the distance H from the front end face of the metal shell to the molten portion is less than 0.5M, it is possible to avoid that the temperature of the noble metal tip becomes too high, and the effect of the noble metal tip according the present invention is relatively small. However, when the spark plug satisfies the expression of H>=0.5M, the noble metal tip is likely to be high temperature, and exhibits the great effect that the grain growth is prevented.

When the distance H is further extended, it might cause an erosion of the front end portion of the ground electrode. Therefore, it is preferable that the outer diameter M of the thread portion and the distance H satisfy the expression of H<=0.8M.

In accordance with a sixth aspect of the present invention there is provided a method for manufacturing a spark plug as described above, comprising:

wire drawing in which a wire rod made of a platinum alloy containing platinum as a principal component is formed into a wire having generally the same diameter as the noble metal tip, and wire cutting in which the thus-formed wire is ground and cut by a wire having a grinding material on a surface thereof.

In view of preventing the grain growth of the noble metal tip, it is effective to prevent the residual stress of the noble metal tip.

According to the sixth aspect, the noble metal tip is formed through the wire drawing process and the cutting processes. In the wire drawing process, the wire rod is drawn into a wire and a side surface (i.e., a side portion of the noble metal tip after the cutting process) of the wire has a relatively larger residual stress compared to the inside of the wire. When the wire is subjected to a shear cutting, stress might remain to a sectioned face (i.e., an end face of the noble metal tip). However, since the wire rod is ground and cut with the wire according to the sixth aspect, it is possible to prevent the stress residual in the sectioned face. Therefore, the sectioned face of the wire having the relatively smaller residual stress compared to the side surface of the wire serves as the end face of the noble metal tip. As a result, an end face opposed to the end face that is joined to the ground electrode constitutes the front end portion of the noble metal tip. Therefore, in the noble metal tip according to the sixth aspect, the grain growth in the front end portion is unlikely to occur especially in the initial state in use, and it is possible to effectively prevent an expansion of the spark discharge gap. Further, since the residual stress inside of the noble metal tip can be reduced as much as possible, the spark plug according to the present invention can exhibit an excellent effect to prevent the grain growth. Therefore, deterioration in grain boundary intensity under the high temperature environment can be further prevented, and separation of the noble metal tip can be assuredly prevented.

In accordance with a seventh aspect of the present invention there is provided a method for manufacturing a spark plug as described above, wherein the wire drawing is a hot wire drawing.

Since the wire rod is formed by the hot wire drawing, i.e., the wire rod or the like is wire drawn under the heat, stress remaining inside of the wire rod is small. As a result, the above-mentioned effects can be further enhanced.

DETAILED DESCRIPTION OF PREFERRED EMBODIMENTS

Figure 1:
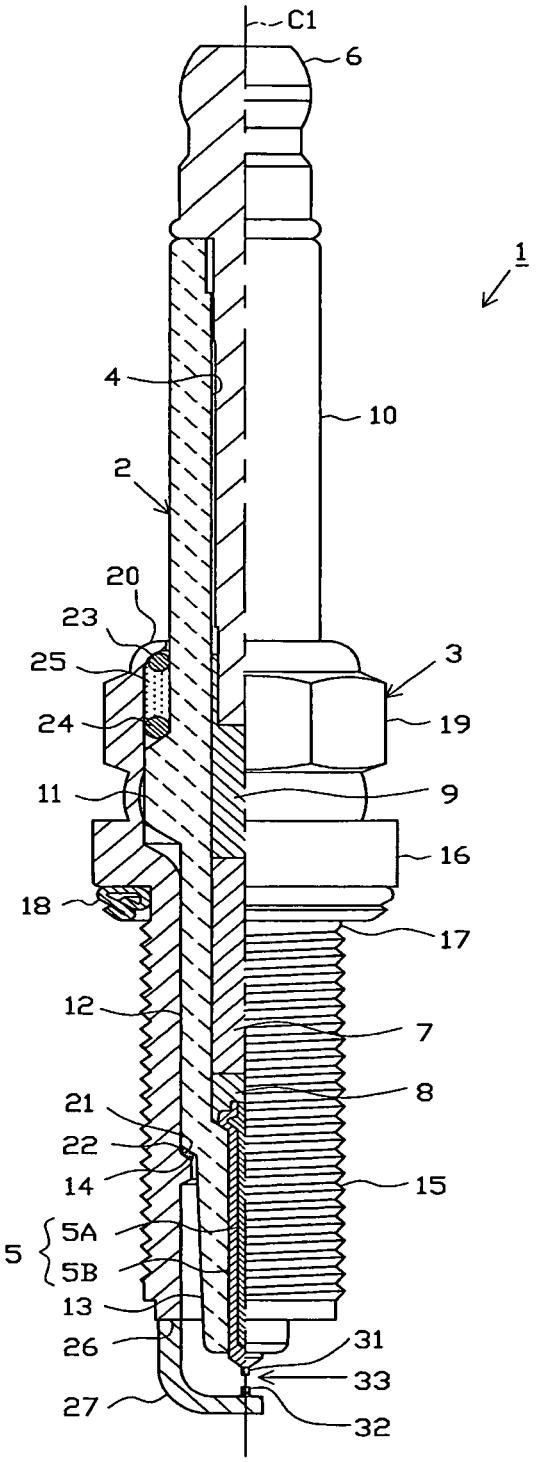
FIG. 1 is a partially sectioned front view showing a spark plug according to an embodiment.

An embodiment of the present invention will be described with reference to the drawings. FIG. 1 is a partially sectioned front view showing a spark plug 1. In FIG. 1, an axial C1 direction of the spark plug 1 is referred to as the top-to-bottom direction in the drawing. A lower side of the drawing is referred as a front end side, and an upper side of the drawing is referred as a rear end side of the spark plug 1.

The spark plug 1 is comprised of an insulator 2 assuming a cylindrical shape and a cylindrical metal shell 3 holding the insulator therein.

The insulator 2 has an axial bore 4 extending along the axis C1. A center electrode 5 is inserted and held at a front end side of the axial bore 4, while a terminal electrode 6 is inserted and held at a rear end side thereof. A resistor 7 is disposed between the center electrode 5 and the terminal electrode 6 in the axial bore 4, and both ends of the resistor 7 are electrically connected to the center electrode 5 and the terminal electrode 6, respectively, through conductive glass seal layers 8 and 9. The center electrode 5 projects from, and is fixed to, the front end of the insulator 2, and the terminal electrode 6 projects from and is fixed to a rear end of the insulator 2.

The center electrode 5 is comprised of an inner layer 5A made of copper or a copper alloy and an outer layer 5B made of a nickel alloy. Further, the rod-like (columnar) center electrode 5 has a reduced diameter at the front end side thereof and a front end face that assumes a flat face. A columnar noble metal tip 31 is joined to the front end face of the center electrode 5 by laser beam welding, electron beam welding, or resistance welding. In this embodiment, the noble metal tip 31 is made of noble metal (e.g., Pt-5Ir) containing platinum (Pt) as a principal component and iridium (Ir).

On the other hand, the insulator 2 is made of sintered alumina or the like as is commonly known. The insulator 2 includes a rear end side body portion 10 formed on the rear end side, a large diameter portion 11 radially outwardly projecting at the front end side with respect to the rear end side body portion 10, a middle body portion 12 having an outer diameter smaller than that of the large diameter portion 11, and an insulator nose 13 having an outer diameter smaller than that of the middle body portion 12. In the insulator 2, the large diameter portion 11, the middle body portion 12 and most of the insulator nose 13 are accommodated in the cylindrical metal shell 3. A taper shaped step portion 14 is formed in a connecting portion between the insulator nose 13 and the middle body portion 12 so that the insulator 2 is engaged with the metal shell 3.

The metal shell 3 is made of a low carbon steel material and assumes a cylindrical shape. A thread (male thread) 15 used for mounting the spark plug 1 on an engine head is formed on an outer circumferential face of the metal shell 3. Further, a seat 16 is formed on the outer circumferential face at the rear end side of the thread 15, and a ring-shape gasket 18 is provided on a thread neck 17 formed at the rear end of the thread 15. A hexagonal tool engagement portion 19, viewed in a cross-section, used for engaging with a tool, such as a wrench, that is used for mounting the metal shell 3 on the engine head is formed at the rear end side of the metal shell 3. Further, a caulking portion 20 for holding the insulator 2 is formed at the rear end portion of the metal shell 3.

Further, the metal shell 3 has a taper-shaped step portion 21 at an inner circumferential face thereof so as to engage with the insulator 2. The insulator 2 is inserted toward the front end side from the rear end side of the metal shell 3 and an opening portion of the rear end side of the metal shell 3 is radially inwardly caulked (i.e., forming the caulking portion 20) while the taper portion 14 is engaged with the step portion 21 of the metal shell 3. Notably, annular plate packing 22 is disposed between the step portions 14, 21 of the insulator 2 and the metal shell 4. In this way, the airtightness in a combustion chamber is maintained, and the air-fuel mixture entering between the insulator nose 13 of the insulator 2 exposed to the combustion chamber and an inner circumferential face of the metal shell 3 is prevented from leaking outside.

Furthermore, in order to make a perfect sealing with caulking, in the rear end side of the metal shell 3, annular rings 23 and 24 are disposed between the metal shell 3 and the insulator 2, and talc powder 25 is filled between the rings 23, 24. That is, the metal shell 3 holds the insulator 2 through the plate packing 22, the rings 23, 24 and the talc 25.

Figure 2:
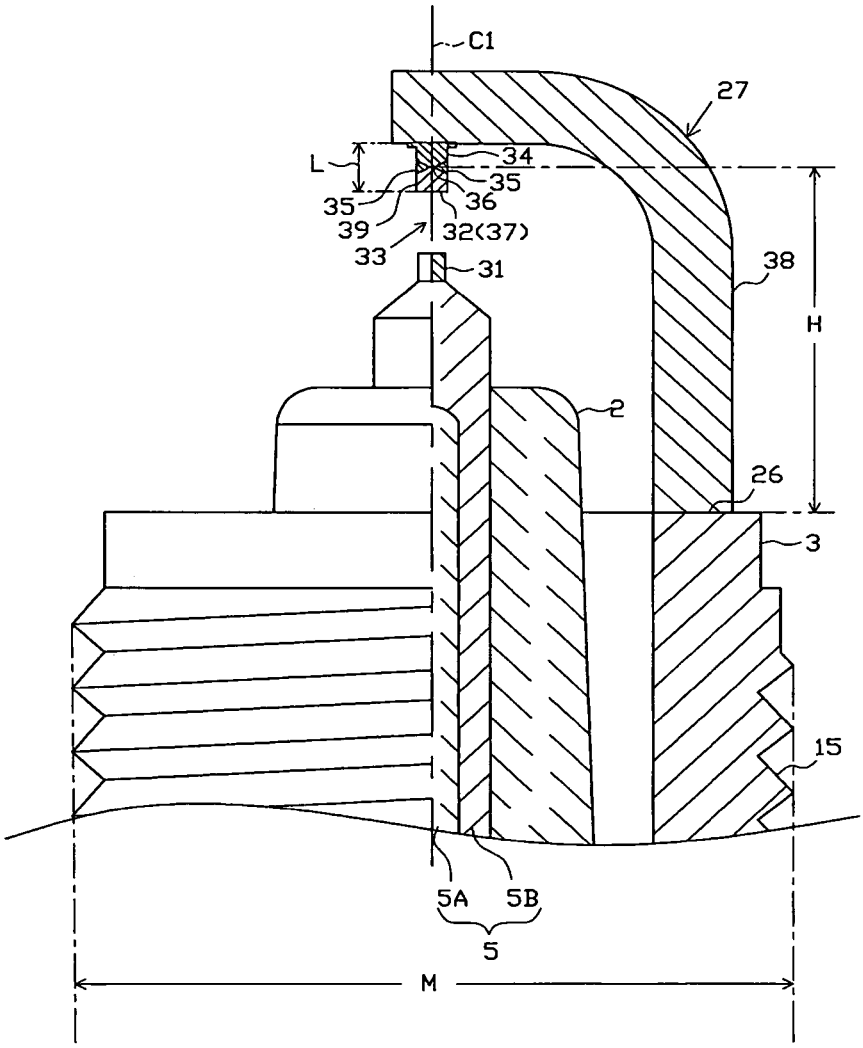
FIG. 2 is a partially sectioned front view showing a front end portion of a spark plug according to an embodiment.

Moreover, a ground electrode 27 made of a nickel alloy is joined to a front end face 26 of the metal shell 3. That is, the ground electrode 27 is disposed so that a rear end portion thereof is welded to the front end face 26 of the metal shell 3, and a front end side of the ground electrode 27 is bent so that a side face faces a front end portion (the noble metal tip 31) of the center electrode 5. As shown in FIG. 2, the ground electrode 27 includes a generally L-shaped ground electrode main body 38 and a convex portion 34 projecting from the front end side face of the ground electrode main body 38. In this embodiment, the convex portion 34 is formed by resistance welding of a columnar tip made of a nickel alloy.

Further, a columnar noble metal tip 32 is joined to a front end face (contact face) 36 of the convex portion 34 of the ground electrode 27. More particularly, in the state that the noble metal tip 32 is brought into contact with the contact face 36 of the convex portion 34, an outer edge of the contact face 36, which is a boundary between the convex portion 34 and the noble metal tip 32, is welded by laser or the like to the noble metal tip 32 through forming a molten portion 35. According to this embodiment, a clearance between the noble metal tip 32 and the noble metal tip 31 serves as a spark discharge gap 33. Notably, the noble metal tip 31 provided on the center electrode 5 may be omitted. In this case, the spark discharge gap 33 is formed between the noble metal tip 32 and a main body of center electrode 5.

In this embodiment, a projection length L from the ground electrode main body 38 to a front end face 37 of the noble metal tip 32 is set to be 0.4 mm or more to 1.6 mm or less (e.g., 1 mm). Further, an outer diameter M of a thread portion 15 and a distance H between the front end face 26 of the metal shell 5 and the molten portion 35 (contact face 36) in the axial C1 direction satisfy the expression of H>=0.5M.

The noble metal tip 32 is made of a Pt alloy (e.g., Pt-30Ir or the like) containing Pt as a principal component. The Pt alloy has a mean particle size of 70 micrometers or less after being heated at 1100 degrees C. under the air atmosphere for 50 hours. In addition, the Pt alloy contains at least one component selected from rhodium (Rh), Ir, Ni and ruthenium (Ru). Notably, the Pt alloy may also contain at least either a metal oxide or a rare earth oxide. However, it is preferable that the total content of the metal oxide and/or the rare earth oxide falls within the range from 0.05 mass % or more to 2 mass % or less.

The noble metal tip 32 whose manufacturing process will be described later is formed so that stress arising from a manufacturing process thereof hardly remains inside of the noble metal tip 32. Next, a method for manufacturing the noble metal tip 32 and a method for manufacturing the spark plug 1 provided with the noble metal tip 32 will be described.

Figure 3:
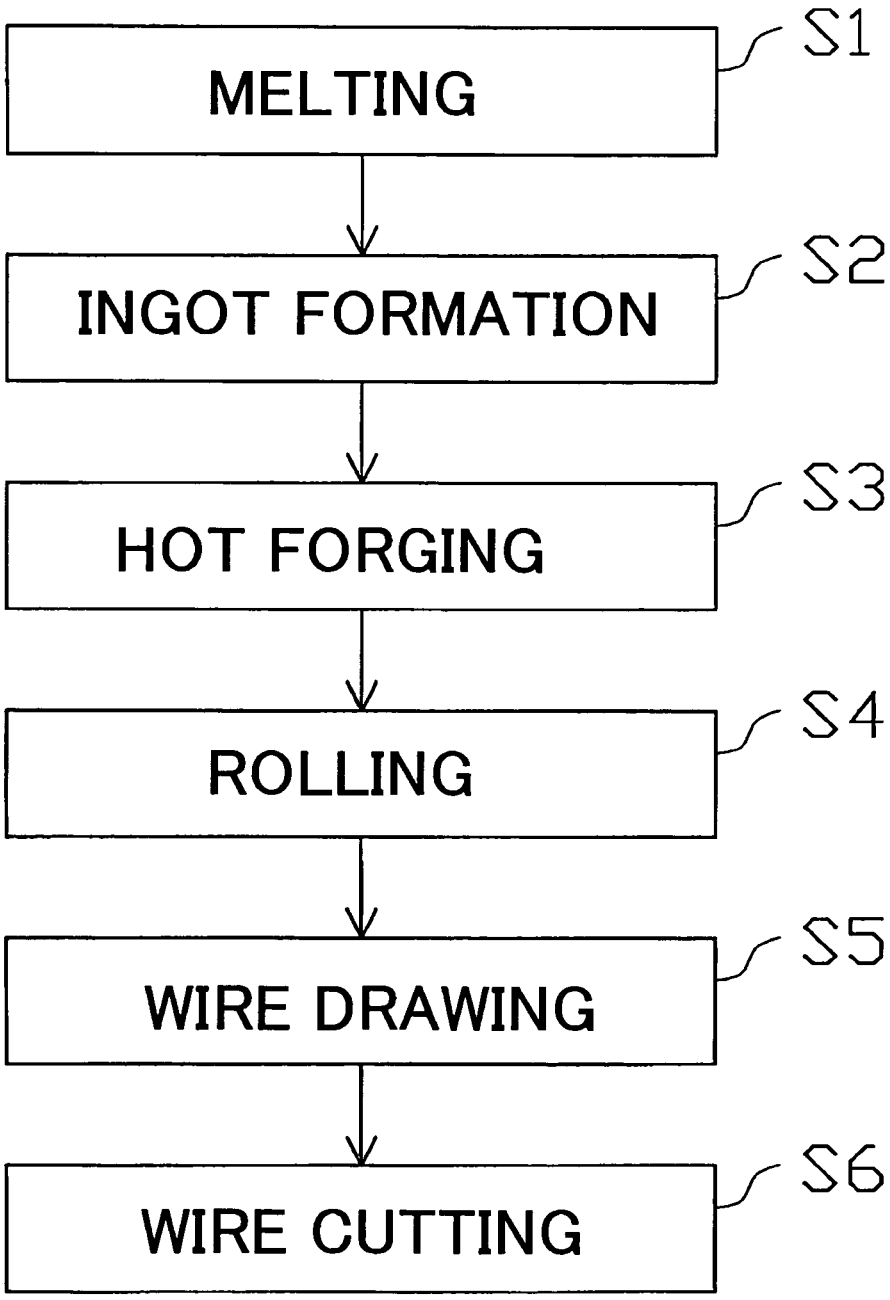
FIG. 3 is a flow chart for explaining a method for manufacturing a noble metal tip according to an embodiment.

With reference to FIG. 3, the method for manufacturing the noble metal tip 32 will be described. First, a mixture of a predetermined quantity of Pt powder and a predetermined quantity of Ir powder is press-molded. Then, the thus-molded body is subjected to arc melting (S1 in FIG. 3) to form an ingot (S2 in FIG. 3). Subsequently, the ingot is subjected to a hot forging to thereby form a square log with about 10 mm squares (S3 in FIG. 3), and cut the square log. The thus-cut square log is subjected to a rolling process to thereby form a square log with about 1 mm square (equivalent to a wire rod in the present invention) (S4 in FIG. 3). The rolling process is conducted at a rate of about 95% decrease in cross-sectional area of the square log with respect to the diameter thereof.

Thereafter, the thus-rolled square log is repeatedly drawn at a rate of about 95% decrease in cross-sectional area using a plurality of circular dies so as to form a wire rod having a diameter of 0.7 mm (S5 in FIG. 3). Using a plurality of burners disposed along a moving direction of the square log, the wire drawing is conducted after heating each circular die and the square log at a predetermined temperature (e.g., about 700 degrees C. for the circular die and 1000 degrees C. for the square log).

Subsequently, the thus-formed wire rod is cut (S6 in FIG. 3) in a predetermined length (e.g., about 0.5 mm) by pressing a wire, where grinding material (e.g., minute diamond material) is provided on the surface thereof, to form the noble metal tip 32. More particularly, the wire is disposed on a plurality of belt pulleys in a circular shape (wire saw). The circular wire rotates in one direction and pressed against the wire rod so that the wire rod is ground and cut. In addition, a plurality of wire saws may be located along the moving direction of the wire rod so as to simultaneously cut the wire rod at a plurality of locations to thereby produce a plurality of noble metal tips 32.

Next, a method for manufacturing the spark plug 1 will be described. First, the metal shell 3 is prepared beforehand. That is, a through-hole is formed in a columnar-shaped metal material (e.g., iron material or stainless steel material, such as S17C and S25C) by a cold forging processing to produce a primary body of the metal shell 3. Then, an outer shape of the thus-produced body is prepared by a cutting process to thereby form a metal shell intermediate body.

Next, the rod-like ground electrode main body 38 made of nickel alloy (such as Inconel alloy) is joined by resistance welding to a front end face of the metal shell intermediate body. Since the resistance welding causes so-called "rundown," the thread portion 15 is formed in a predetermined region of the metal shell intermediate by rolling process after removing the "rundown." In this way, the metal shell 3 to which the ground electrode main body 38 is welded is obtained. Zinc plating or nickel plating is applied to the metal shell 3 to which the ground electrode main body 38 is welded. Notably, chromate treatment may be further performed to the surface of the thus-plated metal shell 3 in order to improve corrosion-resistance thereof.

While the columnar Ni-alloy tip which constitutes the convex portion 34 is joined to the front end side face of the ground electrode main body 38, the noble metal tip 32 is joined to the convex portion 34. More particularly, the noble metal tip 32 is aligned with an end surface (the contact face 36) of the Ni-alloy tip, and laser welded along the outer edge of the end face to thereby join the noble metal tip 32 to the Ni-alloy tip through forming the annular molten portion 35 when viewed from the front end of the noble metal tip 32. Subsequently, the other end of the Ni-alloy tip is joined to the front end side face of the ground electrode main body 38 by resistance welding. In this way, the ground electrode 27 on which the noble metal tip 32 is joined to the convex portion 34 (Ni-alloy chip) is formed. In order to achieve a secure welding, plating in a welded area is removed prior to the welding process, or alternatively, a masking is applied to an area for welding in the plating process. Further, after the Ni-alloy tip is welded to the ground electrode main body 38 (after forming the convex portion 34), the noble metal tip 32 may be joined to the convex portion 34. In addition, the welding or the like of the noble metal tip 32 may be conducted after an assembly process (later described).

On the other hand, the insulator 2 is formed separately from the metal shell 3. For example, a raw granulated body for molding is prepared using a raw powder mixture of alumina as a main component and a binder or the like. The granulated body is subjected to a rubber pressing to form a cylindrical mold. Then, thus-formed mold is subject to a grinding process so as to machine the exterior thereof. The thus-ground mold is sintered in a furnace. The insulator 2 is produced through various grinding processes after sintering.

The center electrode 5 is manufactured separately from the metal shell 3 and the insulator 2. That is, the forging process is performed to a Ni-alloy, and a copper-made inner layer 5A is provided in the center of thus-forged alloy in order to improve heat dispersion. Then, the noble metal tip 31 is joined to a front end portion of the center electrode 5 by a resistance welding, a laser welding or the like.

Then, the thus-formed insulator 2 and center electrode 5, the resistor 7, and the terminal electrode 6 are sealed and fixed through the glass seal material 8, 9. Generally, a mixture of borosilicate glass and metallic powder is used as a glass seal. The prepared glass seal is filled in the axial bore 4 of the insulator 2 by sandwiching the resistor 7. Thereafter, the terminal electrode 6 is pressed into the axial bore 4 from the rear side, and the thus-assembled body is fired in the furnace. At this time, a glaze layer formed on a surface of the rear end side body portion 10 of the insulator 2 may be simultaneously fired, or the glaze layer may be formed beforehand.

Thereafter, the thus-formed center electrode 5, the insulator 2 provided with the terminal electrode 6 and the metal shell 3 including the ground electrode 27 are assembled. More particularly, an opening portion in the rear end side of the relatively thin metal shell 3 is radially inwardly caulked so that the insulator 2 and the metal shell 3 are fixed through forming the caulking portion 20.

Finally, the spark discharge gap 33 formed between the noble metal tip 31 provided on the front end of the center electrode 5 and the noble metal tip 32 provided on the ground electrode 27 is adjusted by bending the ground electrode 27.

Through a series of these processes, the spark plug 1 having the above-mentioned composition is manufactured.

As described the above, according to this embodiment, the projection length L from the ground electrode main body 38 to the front end face 37 of the noble metal tip 32 falls within the range from 0.4 mm or more to 1.6 mm or less. Thus, improvement in ignitability and flame propagation property is achievable.

The Pt alloy constituting the noble metal tip 32 has a mean particle size of 70 micrometers or less after being heated at 1100 degrees C. under air atmosphere for 50 hours. Therefore, it is possible to prevent deterioration of the grain boundary intensity under high temperature environment, and further a separation of the noble metal tip 32 can be prevented. As a result, a service-life of the spark plug 1 can be extended.

In order to prevent the grain growth, reduction in internal residual stress is effective. In this embodiment, the noble metal tip 32 is formed through the hot wire drawing process and the wire grinding and cutting processes. That is, the internal residual stress of the noble metal tip 32 is removable by hot wire drawing. Further, since the noble metal tip 32 is ground and cut by the wire saw, the stress along the cutting plane (i.e., the end face of the noble metal tip 32) is prevented. Therefore, since the residual stress is reduced as much as possible, the noble metal tip 32 according to the invention exhibits a considerable reduction in internal residual stress and assuredly prevents the grain growth. As a result, deterioration in the grain boundary intensity under high temperature environment can be further prevented, and the separation of the noble metal tip 32 can be assuredly prevented.

Next, in order to confirm the effects of the spark plug 1 having the above-described configuration according to the embodiment, the following tests were conducted. Various samples of the noble metal tips were produced. The noble metal samples were made of Pt as a principal component and each sample contained a different amount of Rh, Ir, Ni, Ru, zirconium dioxide ($ZrO_2$) and yttrium oxide ($Y_2O_3$), respectively. Each noble metal tip sample had a different mean particle size after being heated at 1100 degrees C. under the air atmosphere for 50 hours (hereinafter referred to as a "mean particle size after heating"). Various samples of the spark plugs having a ground electrode where one of those noble metal tip samples was joined were produced for a deficiency test. The outline of the deficiency test is as follows. First, after mounting the sample of each spark plug on a four-cylinder DOHC engine having a displacement of 1600 cc, and the engine was operated at a full load (engine rpm=6000 rpm) for 1 minute and then left as an idling condition for 1 minute. This cycle was conducted for 5000 times. After the 5000 cycles, any deficiency of the noble metal tip was checked. The results of the test are shown in Table 1. The samples that had no deficiency are marked as "○," and the samples having the deficiency of the noble metal tip are marked as "x" in Table 1. However, even if there is no deficiency in the noble metal tip, the samples having a noble metal tip where any unusual oxidation has been observed or the samples having a noble metal tip which the formation thereof has been difficult are marked as "Δ."

The sample of each noble metal tip assumed a columnar form and had a length (height) of 0.5 mm and a diameter of 0.7 mm. The sample of noble metal tip was laser welded to the columnar Ni-alloy tip having 0.4 mm in length (height), 0.7 mm in diameter and made of Ni-23Cr-14.4Fe-1.4A1 (INCONEL 601 (registered trademark)). Subsequently, the Ni-alloy tip was joined to the ground electrode main body by resistance welding. In addition, the ground electrode main body was made of the same alloy (INCONEL 601) as the Ni-alloy tip.

In addition, the mean particle size after heating was measured as follows. A columnar tip member having a length of 1.0 mm and a diameter of 0.7 mm was formed through a wire drawing after melting down each alloy component, or through a powder sintering of each alloy component. Then, each tip member is fired in an electric furnace at 1100 degrees C. under the air atmosphere for 50 hours. Thereafter, the grinding and etching processes were conducted to the tip member. After that, the entire cross-sectional area including the center axis of the tip member was taken an image with a metallurgical microscope, and the number of metallic crystals and the cross-sectional area of each metallic crystal were measured. Thereafter, while a mean value of the cross-sectional area of each metallic crystal was calculated, a diameter of a circle having the same area as the thus-calculated mean value was calculated. This diameter serves as the mean particle size after heating.

TABLE 1

| Sample No. | Tip Composition (% by mass) | Mean Particle Size after | Evaluation |
|---|---|---|---|
| 1 | Pt—10Rh | 200 | X |
| 2 | Pt—20Rh | 175 | X |
| 3 | Pt—20Ir | 100 | X |
| 4 | Pt—30Ir | 45 | ○ |
| 5 | Pt—10Ru | 88 | X |
| 6 | Pt—20Ru | 57 | ○ |
| 7 | Pt—10Ni | 135 | X |
| 8 | Pt—20Ni | 95 | X |
| 9 | Pt—20Ir—5Rh | 78 | X |
| 10 | Pt—20Ir—5Rh—1Ni | 68 | ○ |
| 11 | Pt—10Rh—10Ru | 140 | X |
| 12 | Pt—10Rh—20Ru | 87 | X |
| 13 | Pt—10Rh—30Ru | 65 | ○ |
| 14 | Pt—10Rh—1Ni | 120 | X |
| 15 | Pt—10Rh—2Ni | 61 | ○ |
| 16 | Pt—10Ni—5Ir | 67 | ○ |
| 17 | Pt—10Rh—2W | 45 | Δ |
| 18 | Pt—10Rh—2Ta | 49 | Δ |
| 19 | Pt—10Rh—2Nb | 52 | ○ |
| 20 | Pt—10Rh—0.03$ZrO_2$ | 83 | X |
| 21 | Pt—10Rh—0.05$ZrO_2$ | 66 | ○ |
| 22 | Pt—10Rh—0.1$ZrO_2$ | 23 | ○ |
| 23 | Pt—10Rh—1$ZrO_2$ | 18 | ○ |
| 24 | Pt—10Rh—2$ZrO_2$ | 14 | ○ |
| 25 | Pt—10Rh—2.5$ZrO_2$ | 11 | Δ |
| 26 | Pt—10Rh—0.03$Y_2O_3$ | 77 | X |
| 27 | Pt—10Rh—0.05$Y_2O_3$ | 59 | ○ |
| 28 | Pt—10Rh—0.1$Y_2O_3$ | 20 | ○ |
| 29 | Pt—10Rh—1$Y_2O_3$ | 15 | ○ |
| 30 | Pt—10Rh—2$Y_2O_3$ | 12 | ○ |
| 31 | Pt—10Rh—2.5$Y_2O_3$ | 10 | Δ |
| 32 | Pt—10Ni—0.1$ZrO_2$ | 25 | ○ |
| 33 | Pt—10Ni—0.1$Y_2O_3$ | 15 | ○ |

As shown in Table 1, separation of the noble metal tip was found in the samples (samples 1, 2, 3, 5, 7, 8, 9, 11, 12, 14, 20 and 26) having the mean particle size after heating of greater than 70 micrometers. Thus, when the mean particle size after heating exceeds 70 micrometers, the grain boundary intensity became low under the high temperature environment and durability of the noble metal tip deteriorated. As a result, the separation of the noble metal tip occurred.

On the other hand, the samples having the mean particle size after heating of 70 micrometers or less (samples 4, 6, 10, 13, 15, 16, 17, 18, 19, 21, 22, 23, 24, 25, 27, 28, 29, 30, 31, 32 and 33), no separation of the noble metal tip was observed. Thus, when the mean particle size after heating was 70 micrometers or less, the grain boundary intensity was relatively high even under the high temperature environment. Thus, since the durability of the noble metal tip was sufficient, the separation of the noble metal tip can be prevented.

The samples containing $ZrO_2$ or $Y_2O_3$ of 0.05 mass % or more to less than 2.0 mass % (samples 21, 22, 23, 24, 27, 28, 29, 30, 32 and 33) exhibited an effect of preventing the separation of the noble metal tip because the mean particle size after heating was not further increased. However, in the samples having the total content of $ZrO_2$ or $Y_2O_3$ was less than 0.05 mass % (samples 20 and 26), the mean particle size after heating exceeded 70 micrometers, and the separation of the noble metal tip occurred. Although the separation of the tip was prevented in the samples having the total content of $ZrO_2$ or $Y_2O_3$ exceeded 2.0 mass % (samples 25 and 31), workability of the noble metal tip was deteriorated, whereby it was difficult to form the noble metal tip into the above-mentioned shape.

Further, the samples containing tungsten (W) and tantalum (Ta) of 2 mass % or more (samples 17 and 18) exhibited no separation of the noble metal tip even though the mean particle size after heating was 70 micrometers or less. However, unusual oxidation was found in those samples. That is, although there are various compositions having Pt as a principal component and which enable the mean particle size after heating to be 70 micrometers or less, the samples containing an appropriate amount of Rh, Ir, Ni, Ru, $ZrO_2$ and $Y_2O_3$ or the like can prevent deterioration in grain boundary intensity without any deterioration in anti-oxidization property.

Next, samples of the spark plug each having various projection length L from the ground electrode main body to the front end face of the noble metal tip were prepared for conducting an ignitability test. The outline of the ignitability test is as follows. The spark plug samples were mounted on a four-cylinder DOHC engine having a displacement of 1600 cc. The engine was operated under an idling condition with ±10% of the rotation rate (e.g., 800 rpm±80 rpm). Then, timing advance limitation was measured. The test result is shown in a graph in FIG. 4. The noble metal tip on the ground electrode assumed a columnar shape with a diameter of 0.7 mm and was made of Pt-30Ir (mean particle size after heating of 45 micrometers). Further, the columnar noble metal tip on the center electrode assumed a columnar shape with a diameter of 0.6 mm and contained Ir as a principal component and 5 mass % Pt. The ground electrode was made of Ni-32Cr-14.4Fe-1.4A1 alloy, and the spark discharge gap of each sample was 1.1 mm.

Figure 4:
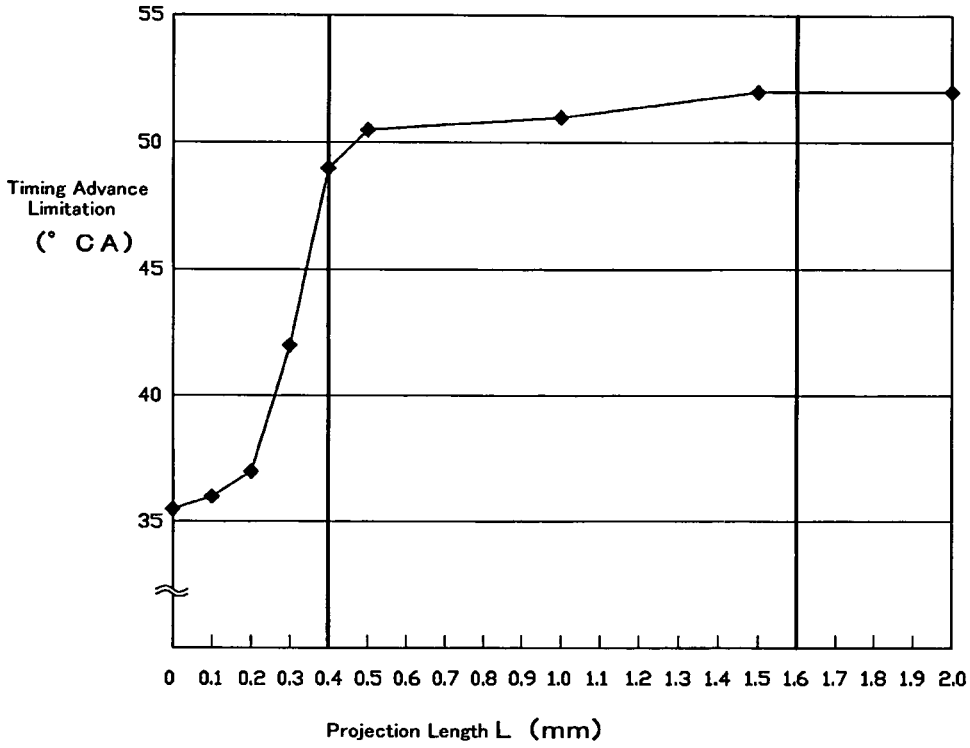
FIG. 4 is a line graph showing a relationship between a projection length and a timing advance limitation in an ignitability evaluation test.

As shown in FIG. 4, the timing advance limitation was remarkably increased when the projection length L was 0.4 mm or more compared to the case where the projection length L was less than 0.4 mm. The ignitability was sufficiently improved. However, when the projection length L exceeded 1.6 mm, the noble metal tip tended to suffer erosion. Therefore, the projection length L is preferably 0.4 mm or more to 1.6 mm or less.

Next, noble metal tip samples having the same composition as those of the sample 3 (Pt-20Ir) and the sample (Pt-30Ir) of Table 1 were prepared. The noble metal tip samples were joined through the molten portion. Spark plug samples each having different ratio "H/M" were prepared, where M (mm) is the outer diameter of the thread portion, and where H (mm) is the distance from the metal shell front end face to the molten portion in the axial direction. The spark plug samples were subjected to a separation test. The result of the test is shown in Table 2. When no separation of the noble metal tip was observed in the samples, it was basically marked as "○". When any separation was observed, it was marked as "x". Further, "Δ" represented the case where the separation of the noble metal tip was not observed, but the ground electrode suffered erosion.

TABLE 2

| Nominal Diameter of Thread (M) | Shortest Distance (H) | H/M | Evaluation Pt—20Ir (100 μm) | Evaluation Pt—30Ir (45 μm) |
|---|---|---|---|---|
| 14 | 5 | 0.36 | ○ | ○ |
| | 6 | 0.43 | ○ | ○ |
| | 7 | 0.50 | X | ○ |
| | 8 | 0.57 | X | ○ |
| | 9 | 0.64 | X | ○ |
| | 10 | 0.71 | X | ○ |

TABLE 2-continued

| Nominal Diameter of Thread (M) | Shortest Distance (H) | H/M | Evaluation Pt—20Ir (100 μm) | Evaluation Pt—30Ir (45 μm) |
|---|---|---|---|---|
| | 11 | 0.79 | X | ○ |
| | 12 | 0.86 | X | ○ |
| | 13 | 0.93 | X | Δ |
| | 14 | 1.00 | X | Δ |
| 12 | 4 | 0.33 | ○ | ○ |
| | 5 | 0.42 | ○ | ○ |
| | 6 | 0.50 | X | ○ |
| | 7 | 0.58 | X | ○ |
| | 8 | 0.67 | X | ○ |
| | 9 | 0.75 | X | ○ |
| | 10 | 0.83 | X | ○ |
| | 11 | 0.92 | X | Δ |
| | 12 | 1.00 | X | Δ |
| 10 | 3 | 0.30 | ○ | ○ |
| | 4 | 0.40 | ○ | ○ |
| | 5 | 0.50 | X | ○ |
| | 6 | 0.60 | X | ○ |
| | 7 | 0.70 | X | ○ |
| | 8 | 0.80 | X | ○ |
| | 9 | 0.90 | X | Δ |
| | 10 | 1.00 | X | Δ |

As shown in Table 2, in the composition (Pt-20Ir) having the mean particle size after heating of over 70 micrometers (the mean particle size=100 micrometers in Table 2), the separation of the noble metal tip was observed when the ratio H/M was 0.5 or more. The possible reason for this is that the noble metal tip is made closer to the center of a combustion chamber and exposed at a high temperature as the ratio H/M becomes large. Therefore, the grain growth was advanced, and deterioration in the grain boundary intensity occurred.

On the other hand, in the composition (Pt-30Ir) having the mean particle size after heating of 70 micrometers or less (the mean particle size=45 micrometers in Table 2), the separation of the noble metal tip was not observed when the ratio H/M was 0.5 or more (i.e., the spark discharge gap was made closer to the center of the combustion chamber). This is because the grain growth is prevented even under the high temperature environment whereby deterioration in grain boundary intensity is prevented. That is, prevention of the separation of the noble metal tip and an improvement in flame propagation property are simultaneously achievable when the Pt alloy has the mean particle size after heating of 70 micrometers or less and the ration H/M is 0.5 or more. However, erosion of the ground electrode was observed when the ratio H/M exceeded 0.8. Thus, the ratio H/M is preferably 0.8 or less.

The present invention is not limited to the above-described embodiment, and it may, for example, carry out as follows. Further, other embodiments or modifications of the present invention that are not illustrated below may also be possible.

Figure 5:
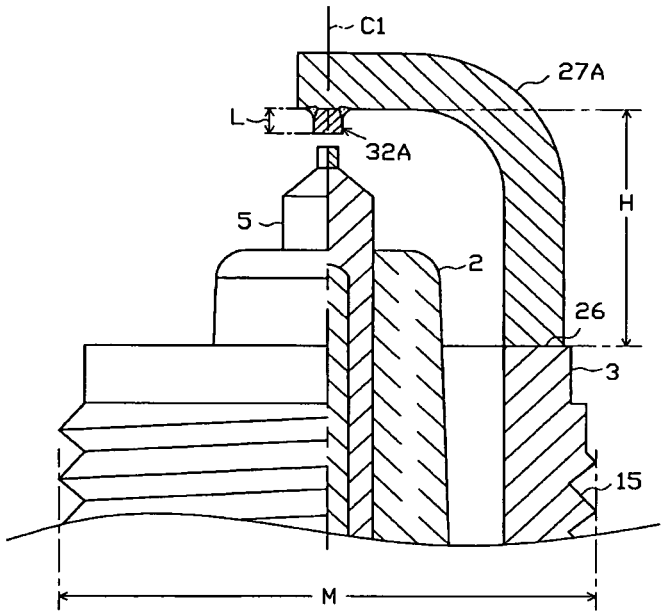
FIG. 5 is a partially sectioned front view showing a front end portion of a spark plug according to another embodiment.

(a) In the above-mentioned embodiment, the noble metal tip 32 is joined to the ground electrode main body 38 through the convex portion 34. However, as shown in FIG. 5, a noble metal tip 32A may be directly joined to a flat face of a ground electrode 27A (the ground electrode main body) without forming the convex portion 34. Further, in the above-mentioned embodiment, a different type of metal member (the convex portion 34 in the above-mentioned embodiment) is joined to the noble metal tip 32 in the axial direction, but it cannot be joined in the radial direction. That is, a noble metal tip is substantially made of one kind of noble alloy, even though a different type of alloy portion is formed in the welding process. Further, when a part of noble metal tip is covered with a metal thin film made by plating a different type of metal, this configuration is not deemed to be a configuration where a different type of metal member is joined in the radial direction.

(b) In the above-mentioned embodiment, although the noble metal tip 32 assumes a columnar shape and the diameter thereof is specified, it is not necessarily a perfect columnar shape (i.e., the cross-sectional shape thereof is not necessarily a perfect circle). The noble metal tip 32 may assume slightly an ellipse-like shape or a polygonal-like shape. In this case, a diameter of the noble metal tip is defined by an expression of: $2(S/\phi)^{1/2}$, where "S" is a cross-sectional area of the noble metal tip.

(c) In the above-mentioned embodiment, as shown in FIG. 2, the ground electrode 27 is formed in such a manner that the separately formed convex portion 34 is joined to the ground electrode main body 38. The convex portion 34 can be formed by deforming a part of the ground electrode main body 38 as an integral body.

Figure 6:
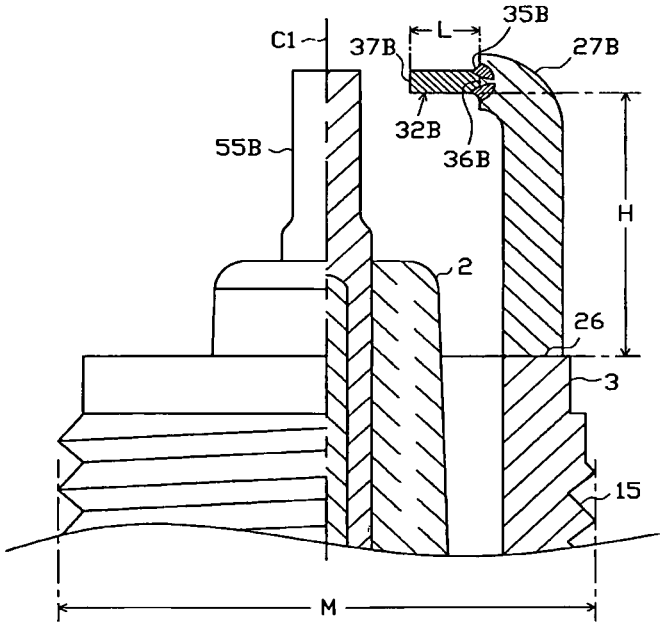
FIG. 6 is a partially sectioned front view showing a front end portion of a spark plug according to another embodiment.
Figure 7:
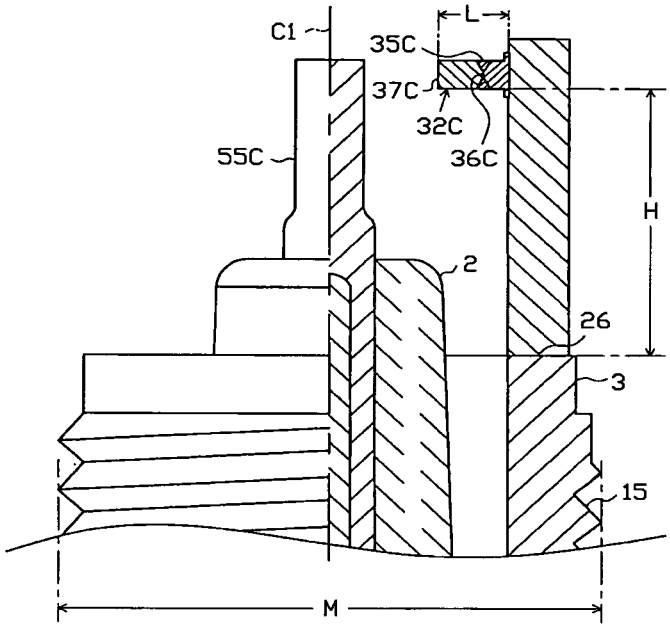
FIG. 7 is a partially sectioned front view showing a front end portion of a spark plug according to another embodiment.
Figure 8:
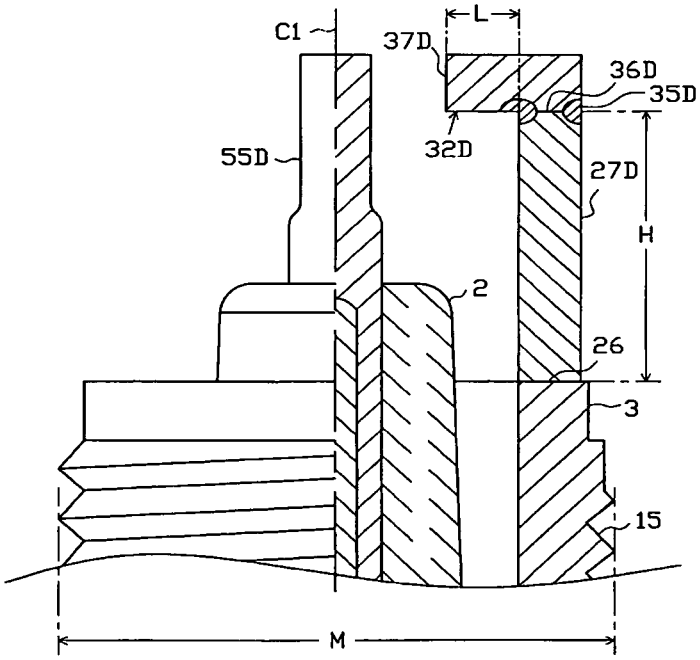
FIG. 8 is a partially sectioned front view showing a front end portion of a spark plug according to another embodiment.
Figure 9:
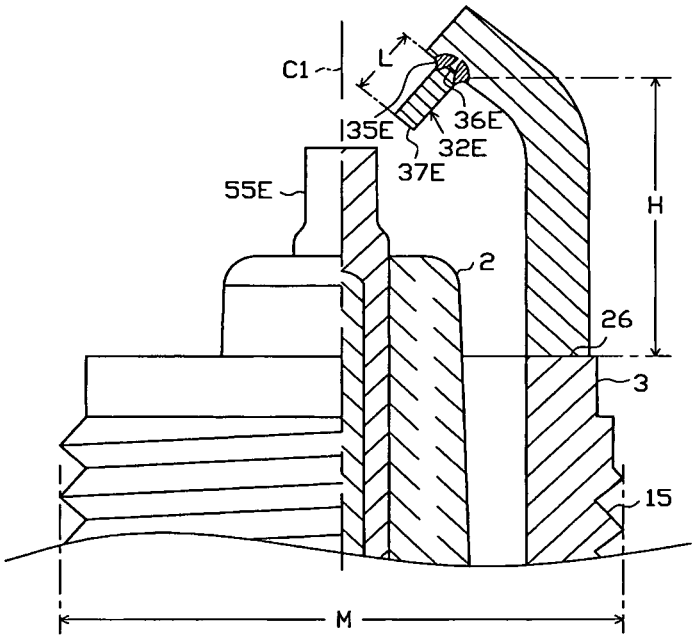
FIG. 9 is a partially sectioned front view showing a front end portion of a spark plug according to another embodiment.
Figure 10:
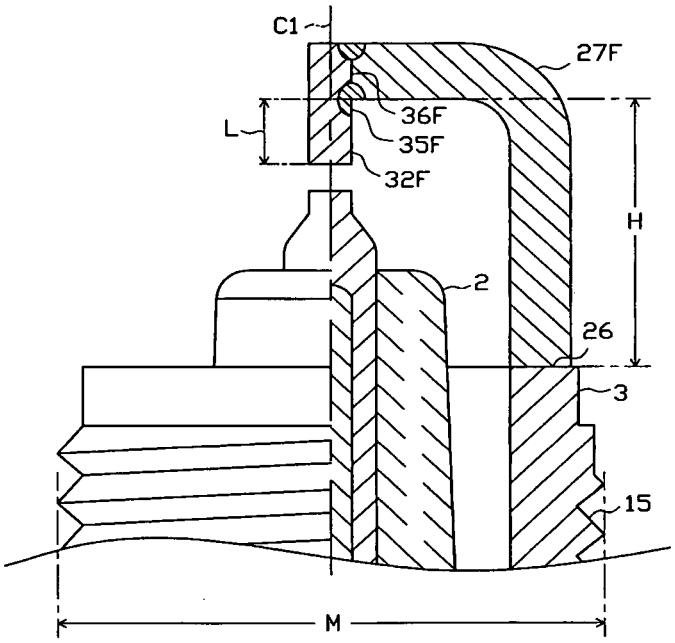
FIG. 10 is a partially sectioned front view showing a front end portion of a spark plug according to another embodiment.

(d) The above-mentioned embodiment has the configuration where the front end face 37 of the noble metal tip 32 faces the front end face of the center electrode 5 (the noble metal tip 31). However, as shown in FIGS. 6, 7 and 8, a front end face 37B, 37C and 37D of a noble metal tip 32B, 32C and 32D may face a side face of a center electrode 55B, 55C and 55D, respectively. Further, as shown in FIG. 9, a front end face 37E of a noble metal tip 32E may face a front end edge of a center electrode 55E. In the above-described embodiment, the noble metal tip 32 is provided on the side face of the ground electrode 27 at the front end side. However, as shown in FIGS. 6, 8 and 10, the noble metal tip 32B, 32D and 32F may be provided on a front end face of a ground electrode 27B, 27D and 27F, respectively. In this case, the outer diameter "M" of the thread portion 15 and the distance "H" from the front end face 26 of the metal shell 3 to a molten portion 35B, 35C, 35D, 35E and 35F (contact face 36B, 36C, 36D, 36E and 36F) preferably satisfy an expression of H>=0.5M.

(e) In the above-described embodiment, the noble metal tip 32 is formed so that any stress does not remain inside. However, stress may remain inside of the noble metal tip 32. For example, the residual stress remaining in the front end portion of the noble metal tip 32 is made smaller than that of the side portion of the noble metal tip 32 (i.e., the Vickers hardness (e.g., 200 Hv) of the front end face 37 of the noble metal tip 32 may be made smaller than that (e.g., 250 Hv) of the side portion 39 of the noble metal tip 32). In this case, the separation (exfoliation) of the noble metal tip 32 can be assuredly prevented as well as preventing a cracking of grain boundary when the mean particle size after heating is 70 micrometers or less. As a result, a service-life of the spark plug 1 can be further extended.

(f) In the above-described embodiment, the ground electrode 27 is joined to the front end of the metal shell 3. The present invention is applicable to a ground electrode which is formed by grinding a part of a metal shell (or a portion of a front end metal that is welded in advance to a metal shell) (e.g., JP,2006-236906,A or the like). Further, the ground electrode 27 may also be joined to a side face of the front end portion of the metal shell 3.

(g) According to the above-described embodiment, the tool engagement portion 19 assumes a hexagonal shape in the cross-section. However, it is not limited to such a shape. The tool engagement portion 19 may assume, for example, a Bi-HEX shape (irregular dodecagon) [ISO22977: 2005 (E)].

(h) Regarding the method for manufacturing the noble metal tip 32, the above-described seventh aspect shows an ideal manufacturing method. However, the method for manufacturing the spark plug according to the present invention is not limited to the above-embodiment. Therefore, the wire drawing may be a cold wire drawing, or the wire drawing may not be necessarily conducted. For example, after rolling an ingot to a plate shape, the plate is subjected to a punching process to thereby form a noble metal tip. A front end portion of the thus-formed noble metal tip may be heated locally so as to remove a residual stress therefrom.

The invention claimed is:

1. A spark plug for internal-combustion engines, comprising:

a cylindrical insulator having an axial bore that penetrates in an axial direction;

a center electrode inserted in the axial bore;

a cylindrical metal shell surrounding an outer circumference of the insulator;

a ground electrode provided on a front end face of the metal shell so that a front end portion of the ground electrode faces a front end face of the center electrode; and a noble metal tip joined to the ground electrode so as to form a spark discharge gap between a front end portion of the noble metal tip and a front end portion of the center electrode, and the noble metal tip made of a platinum alloy that contains platinum as a principal component, wherein a projection length in an axial direction of the spark plug, from a main body of the ground electrode to a front end face of the noble metal tip, falls within the range from 0.4 mm or more to 1.6 mm or less, wherein the platinum alloy has a mean particle size of 70 micrometers or less after being heated at 1100 degrees C. under an air atmosphere for 50 hours, wherein the metal shell has a thread portion on an outer circumference thereof so as to engage with a mounting hole of an engine head of an internal-combustion engine, and wherein the spark plug satisfies the following expression of:

$$H>=0.5M,$$

where "M" is an outer diameter of the thread portion, and where "H" is a distance from a front end face of the metal shell in the axial direction to a molten portion formed by which the noble metal tip and the main body of the ground electrode or a convex portion projecting from the main body of the ground electrode are melted together.

2. The spark plug for internal-combustion engines according to claim 1, wherein a stress remaining in the front end portion of the noble metal tip is smaller than that remaining in a side portion of the noble metal tip.

3. The spark plug for internal-combustion engines according to claim 1 to 2, wherein the platinum alloy contains at least one kind of components selected from rhodium (Rh), iridium (Ir), nickel (Ni) and ruthenium (Ru).

4. The spark plug for internal-combustion engines according to claim 1 or 2, wherein the platinum alloy contains at least either a metal oxide or a rare earth oxide, and wherein a total content of the metal oxide and/or the rare earth oxide falls within the range from 0.05 mass % or more to 2 mass % or less.

5. A method for manufacturing the spark plug for internal-combustion engines, wherein said spark plug is comprised of: a cylindrical insulator having an axial bore that penetrates in an axial direction; a center electrode inserted in the axial bore; a cylindrical metal shell surrounding an outer circumference of the insulator; a ground electrode provided on a front end face of the metal shell so that a front end portion of the ground electrode faces a front end face of the center electrode; and a noble metal tip joined to the ground electrode, wherein the noble metal tip is made of a platinum alloy that contains platinum as a principal component, the platinum alloy having a mean particle size of 70 micrometers or less after being heated at 1100 degrees C. under an air atmosphere for 50 hours, said method for manufacturing comprising:

forming the noble metal tip, including the steps of:

wire drawing in which a wire rod made of said platinum alloy is formed into a wire having a predetermined diameter, and wire cutting in which the thus-formed wire is ground and cut by a wire having a grinding material on a surface thereof;

joining the noble metal tip to the ground electrode so as to form a spark discharge gap between a front end portion of the noble metal tip and a front end portion of the center electrode, wherein a projection length in an axial direction of the spark plug, from a main body of the ground electrode to a front end face of the noble metal tip, falls within the range from 0.4 mm or more to 1.6 mm or less; and providing the metal shell with a thread portion on an outer circumference thereof so as to engage with a mounting hole of an engine head of an internal-combustion engine, wherein the spark plug satisfies the following expression of:

$$H>=0.5M,$$

where "M" is an outer diameter of the thread portion, and where "H" is a distance from a front end face of the metal shell in the axial direction to a molten portion formed by which the noble metal tip and the main body of the ground electrode or a convex portion projecting from the main body of the ground electrode are melted together.

6. The method for manufacturing the spark plug according to claim 5, wherein the wire drawing is a hot wire drawing.

7. A spark plug for internal-combustion engines, comprising:

a cylindrical insulator having an axial bore that penetrates in an axial direction;

a center electrode inserted in the axial bore;

a cylindrical metal shell surrounding an outer circumference of the insulator;

a ground electrode provided on a front end face of the metal shell so that a front end portion of the ground electrode faces a front end face of the center electrode; and a noble metal tip joined to the ground electrode so as to form a spark discharge gap between a front end portion of the noble metal tip and a front end portion of the center electrode, and the noble metal tip made of a platinum alloy that contains platinum as a principal component, wherein a projection length from a main body of the ground electrode to a front end face of the noble metal tip falls within the range from 0.4 mm or more to 1.6 mm or less, wherein the platinum alloy has a mean particle size of 70 micrometers or less after being heated at 1100 degrees C. under an air atmosphere for 50 hours, wherein the metal shell has a thread portion on an outer circumference thereof so as to engage with a mounting hole of an engine head of an internal-combustion engine, and wherein the spark plug satisfies the following expression of:

$$H>=0.5M,$$

where "M" is an outer diameter of the thread portion, and where "H" is a distance from a front end face of the metal shell in the axial direction to a molten portion formed by which the noble metal tip and the main body of the ground electrode or a convex portion projecting from the main body of the ground electrode are melted together.

* * * * *